US010919688B2

(12) United States Patent
Schroer et al.

(10) Patent No.: US 10,919,688 B2
(45) Date of Patent: Feb. 16, 2021

(54) SINGLE FINGER DISPENSING ARTICLE

(71) Applicant: DDP SPECIALTY ELECTRONIC MATERIALS US, LLC, Wilmington, DE (US)

(72) Inventors: Daniel R. Schroer, Midland, MI (US); Marc S. Black, Midland, MI (US); Chad V. Schuette, Midland, MI (US); Christopher J. Siler, Midland, MI (US)

(73) Assignee: DDP SPECIALTY ELECTRONIC MATERIALS US, LLC, Wilmington, DE (US)

( * ) Notice: Subject to any disclaimer, the term of this patent is extended or adjusted under 35 U.S.C. 154(b) by 0 days.

(21) Appl. No.: 16/343,053

(22) PCT Filed: Oct. 16, 2017

(86) PCT No.: PCT/US2017/056739
§ 371 (c)(1),
(2) Date: Apr. 18, 2019

(87) PCT Pub. No.: WO2018/075382
PCT Pub. Date: Apr. 26, 2018

(65) Prior Publication Data

US 2020/0180847 A1 Jun. 11, 2020

Related U.S. Application Data

(60) Provisional application No. 62/410,410, filed on Oct. 20, 2016.

(51) Int. Cl.
*B65D 83/30* (2006.01)
*B65D 83/46* (2006.01)

(52) U.S. Cl.
CPC ..... *B65D 83/303* (2013.01); *B65D 83/46* (2013.01)

(58) Field of Classification Search
CPC ..... B65D 83/303; B65D 83/46
See application file for complete search history.

(56) References Cited

U.S. PATENT DOCUMENTS 5,799,835 A * 9/1998 Gobbel ..... B65D 83/203 222/174
6,202,899 B1 3/2001 Lasserre et al.
(Continued)

FOREIGN PATENT DOCUMENTS

| | | |
|---|---|---|
| GB | 1445202 A | 8/1976 |
| JP | 63144866 U | 3/1988 |
| JP | 2005254142 A | 9/2005 |

OTHER PUBLICATIONS

International Search Report/Written Opinion, dated Jan. 9, 2018, corresponding to International Application No. PCT/US17/56739, filed on Oct. 16, 2017.

*Primary Examiner* — J C Jacyna

(57) ABSTRACT

An article includes a can with a valve stem and a dispensing device attached to the valve stem where the dispensing device includes a hollow base, a hollow tube attached to the hollow base the hollow tube having one or more than one hole proximate to its exit end, a sleeve with a finger pad that slides over the hollow tube and an elastic connector attaching the sleeve to at least one of the hollow base and hollow tube, and a sealing gasket residing between the hollow tube and sleeve, wherein the dispensing device can reversibly move between a closed position where the sleeve seals the one or more than one hole in the hollow tube and an open position where the one or more than one hole in the hollow tube is unsealed by the sleeve and the elastic connector
(Continued)

provides a restoring force to the sleeve when in the open position that directs the sleeve to a closed position.

6 Claims, 6 Drawing Sheets

(56) References Cited

U.S. PATENT DOCUMENTS

| | | | | |
|---|---|---|---|---|
| 8,701,945 | B2 | 4/2014 | Hoagland et al. | |
| 8,720,747 | B2 | 5/2014 | Hoagland et al. | |
| 10,364,092 | B2 * | 7/2019 | Schroer | B65D 83/202 |
| 2018/0354708 | A1 * | 12/2018 | Schroer | B65D 83/345 |
| 2019/0308797 | A1 * | 10/2019 | Schroer | B65D 83/201 |
| 2019/0308798 | A1 * | 10/2019 | Schroer | B65D 83/206 |
| 2020/0047980 | A1 * | 2/2020 | Schroer | B65D 83/40 |

* cited by examiner

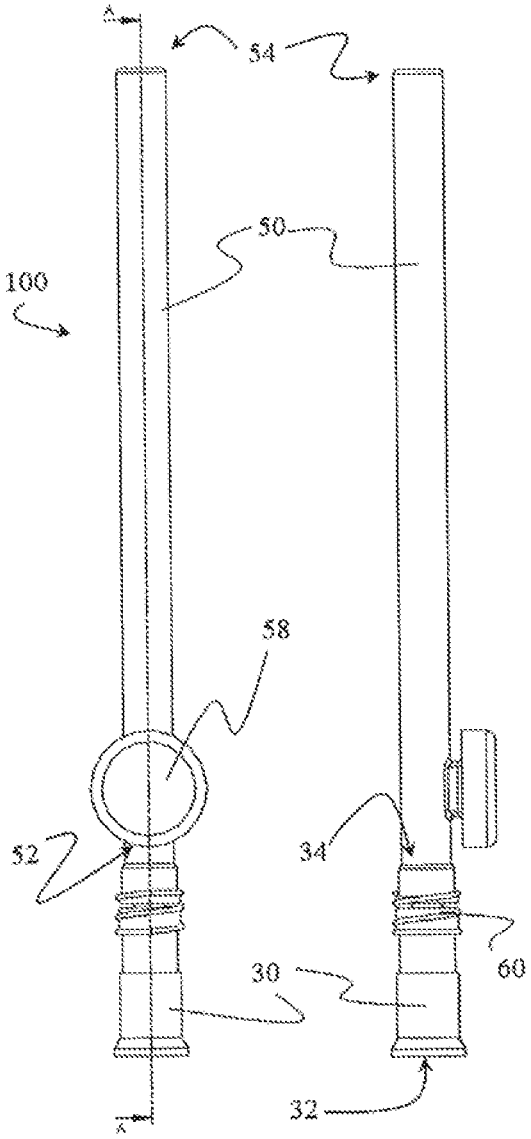
FIG. 2A
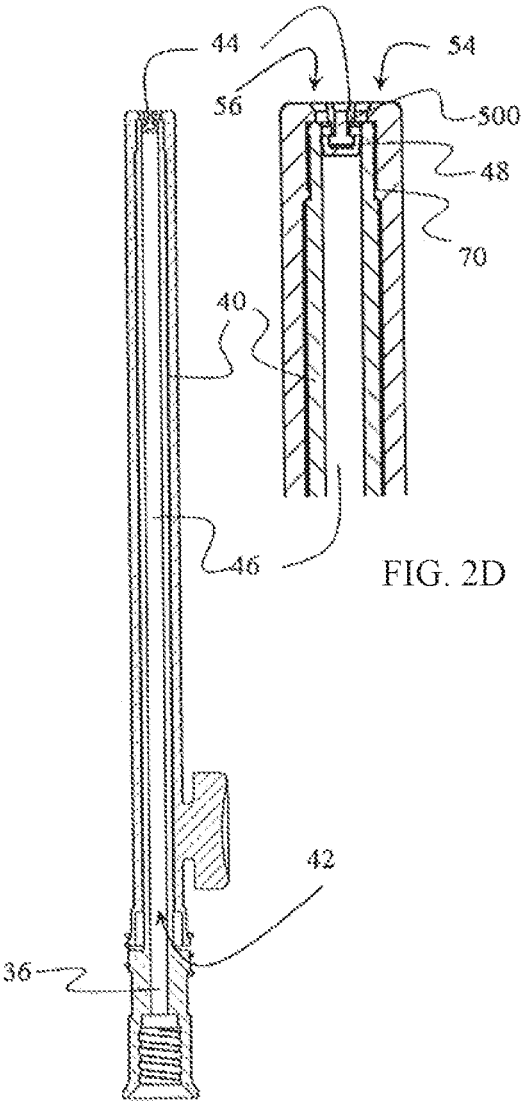
FIG. 2B
FIG. 2D
FIG. 2C

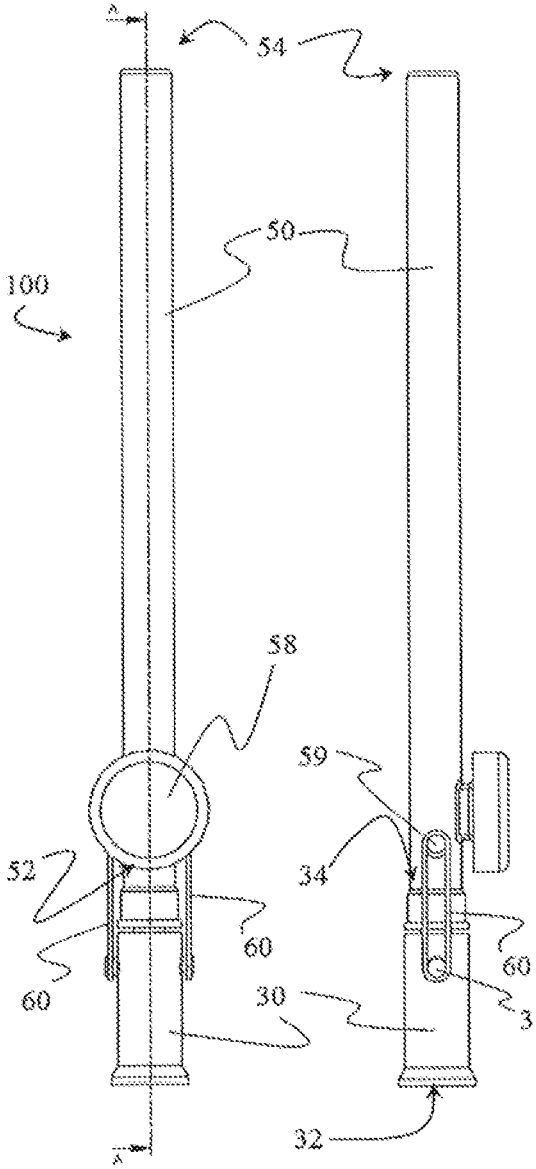
FIG. 3A
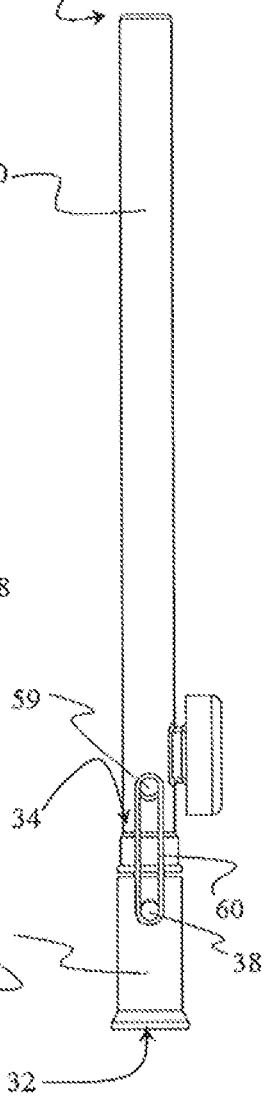
FIG. 3B
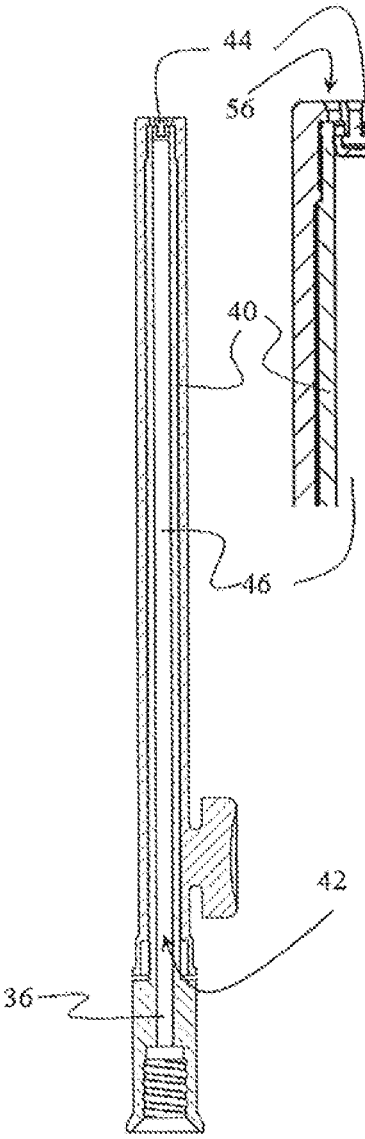
FIG. 3D
FIG. 3C

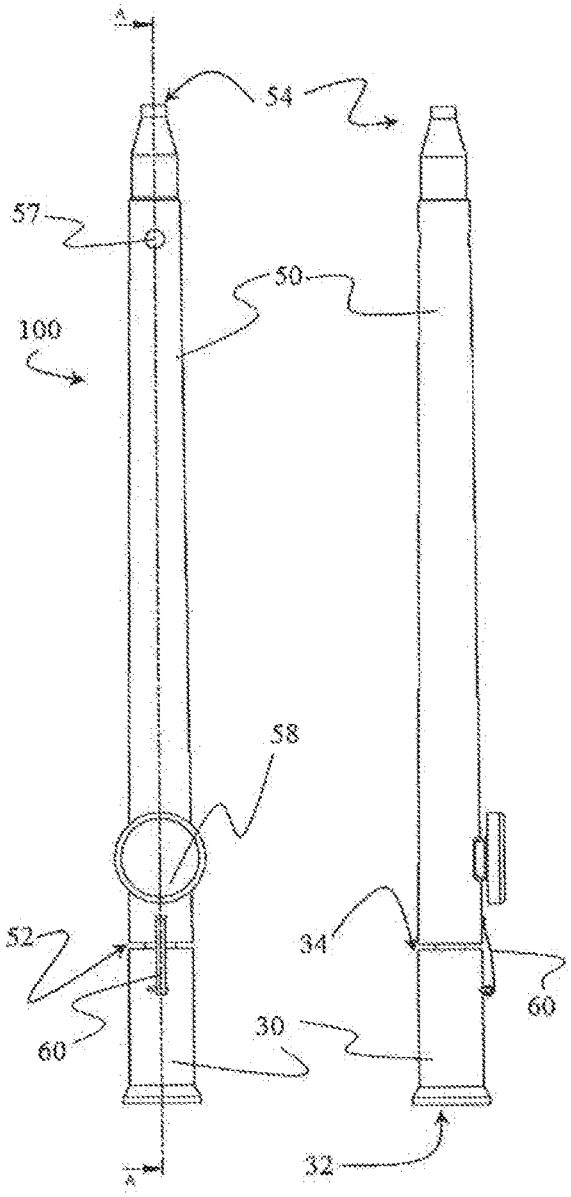
FIG. 5A FIG. 5B
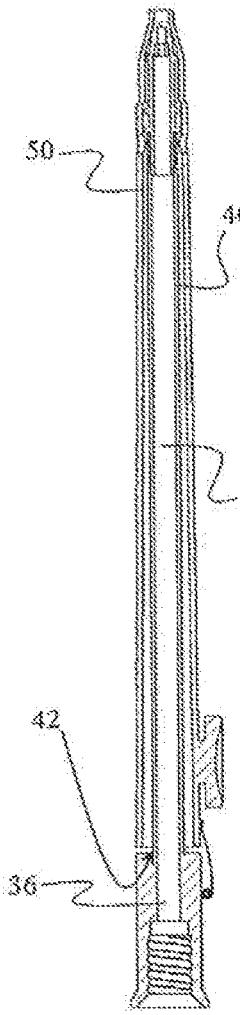
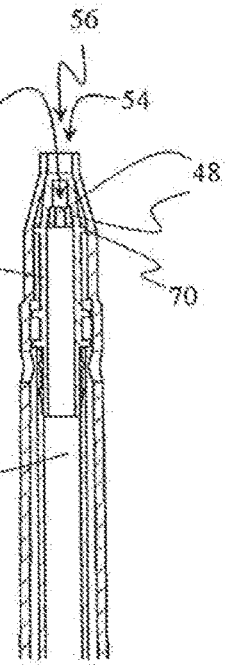
FIG. 5D
FIG. 5C

SINGLE FINGER DISPENSING ARTICLE

BACKGROUND OF THE INVENTION

Field of the Invention

The present invention relates to an article comprising a can and a dispensing device attached to the can.

INTRODUCTION

Numerous products are available in pressurized cans for dispensing by a consumer. Such products include food items such as whipped toppings and frosting, as well as building materials such as spray foam sealants. Dispensing devices for such pressurized cans range from simple tubes attached to or part of a valve stem of the can to elaborate trigger activated devices. Despite a multitude of dispensing devices presently available, there is a need to develop a dispensing device that provides a combination of desirable features and/or capabilities.

It is desirable to provide a dispensing device that allows a user to hold and operate a can and dispenser with one hand in an axial direction with respect to the forearm of the hand to allow access to difficult to reach locations, those locations that require a long reach to access and to make dispensing more comfortable and less fatiguing to a user. At the same time, it is desirable for the dispensing device to be compact and easily packaged with a pressurized can. It is further desirable for the dispensing device to provide a user the ability to start and stop dispensing from the pressurized can with a single hand and that automatically seals the dispenser to prevent dripping when in the closed position. It is desirable for the dispensing device to be operational regardless of orientation.

BRIEF SUMMARY OF THE INVENTION

The present invention offers a dispensing device that allows a user to hold and operate a can with one hand in an axial direction with respect to the forearm of the hand to allow access to difficult to reach locations, those locations that require a long reach to access and to make dispensing more comfortable and less fatiguing to a user. At the same time, the dispensing device is compact and easily packaged with a pressurized can, provides a user the ability to start and stop dispensing from the pressurized can with a single hand and that automatically seals the dispenser to prevent dripping when in the closed position, and is operational regardless of orientation.

In a first aspect, the present invention is an article comprising a can (10) having opposing top (12) and bottom (14) ends with a valve stem (20) extending out from the top end and a dispensing device (100) attached to the valve stem, wherein the dispensing device comprises: (a) a hollow base (30) with opposing entrance (32) and exit (34) ends and defining a hollow base flow channel (36) extending all the way through the base including through the entrance and exit ends with the entrance end removably attached to the valve stem of the can so as to provide fluid communication from the valve stem into the hollow base flow channel of the hollow base; (b) a hollow tube (40) with opposing entrance (42) and exit (44) ends and defining a hollow tube flow channel (46) extending all the way through the hollow tube including through the entrance end and through one or more than one hole (48) proximate to the exit end, wherein the hollow tube is affixed to the hollow base so that the entrance end of the hollow tube is proximate to the exit end of the hollow base so as to establish fluid communication between the hollow base flow channel and hollow tube flow channel and so the two flow channels become continuous; (c) a sleeve (50) with opposing lower (52) and dispensing (54) ends and a finger pad (58) proximate to the lower end, wherein the sleeve extends over and is able to slide over at least a portion of the hollow tube such that the dispensing of the sleeve is proximate to the exit end of the hollow tube and wherein the sleeve defines a dispensing hole (56) proximate to the dispensing end; (d) an elastic connector (60) that attaches the sleeve to at least one of the hollow base and hollow tube proximate to the lower end of the sleeve such that when the sleeve slides along the hollow tube away from the hollow base the elastic connector provides a restoring force to slide the sleeve along the hollow tube back towards the hollow base; and (e) a sealing gasket (70) around the outside of the hollow tube between the hollow tube and sleeve and located between hole or holes (48), which are proximate to the exit end of the hollow tube, and the entrance end of the hollow tube; wherein the dispensing device can reversibly move between an open position and a closed position by sliding the sleeve along the hollow tube, the closed position being characterized by the sleeve sealing the one or more than one hole in the hollow tube proximate to the exit end of the hollow tube and the open position being achieved by sliding the sleeve from the closed position along the hollow tube away from the hollow base so as to unseal the one or more than one hole through the hollow tube allowing fluid flow from the hollow tube flow channel out from the sleeve proximate to the dispensing end; and wherein a single action of pressing a finger against the finger pad is able to slide the sleeve to an open position and to tilt the valve stem to dispense pressurized contents of the can through the hollow tube and wherein subsequent single finger action of releasing pressure on the finger pad results in both return of the valve stem to a closed position for the can and return of the sleeve to a closed position.

The present invention is useful for dispensing contents from a pressurized can.

BRIEF DESCRIPTION OF THE DRAWINGS

FIG. 2 provides an illustration of a dispensing device with (a) side view, (b) side view turned 90 degrees from (a), (c) cut-away side view along viewing line A shown in (a), and (d) a blow up view of dispensing end from (c). The dispensing device of FIG. 2 comprises a spring coiled around the hollow tube between the base and sleeve that serves as an elastic connector and comprises a protrusion on the sleeve that seals a hole on the exit end of the hollow tube when in the closed position.

FIG. 3 provides an illustration of a dispensing device with (a) side view, (b) side view turned 90 degrees from (a), (c) cut-away side view along viewing line A shown in (a), and (d) a blow up view of dispensing end from (c). The dispensing device of FIG. 3 comprises a pair of elastic bands that serve as the elastic connector and comprises a protrusion on the sleeve that seals a hole on the exit end of the hollow tube when in the closed position.

FIG. 5 provides an illustration of a dispensing device with (a) side view, (b) side view turned 90 degrees from (a), (c) cut-away side view along viewing line A shown in (a), and (d) a blow up view of dispensing end from (c). The dispensing device of FIG. 5 comprises a spring tether that serves as an elastic connector. The hollow tube defines multiple holes proximate to the exit end that the sleeve.

DETAILED DESCRIPTION OF THE INVENTION

"And/or" means "and, or alternatively". All ranges include endpoints unless otherwise stated. "Multiple" means more than one. "Fluid" refers to a substance that has no fixed shape and yields to external pressure and includes gas, liquid and gas or liquid continuous formulations. Typically, though not necessarily, fluid refers to liquid and liquid continuous formulations.

"Proximate to" means "close to" and includes "located directly on". When stating "proximate to" a location having an opposing location, the positional relationship means closer to the stated location than the opposing location. For example, if an object is located proximate to end "A" of an article having opposing ends "A" and "B", in the broadest meaning the object is located closer to end "A" than end "B", and the object can be located directly on end "A".

Figure 1:
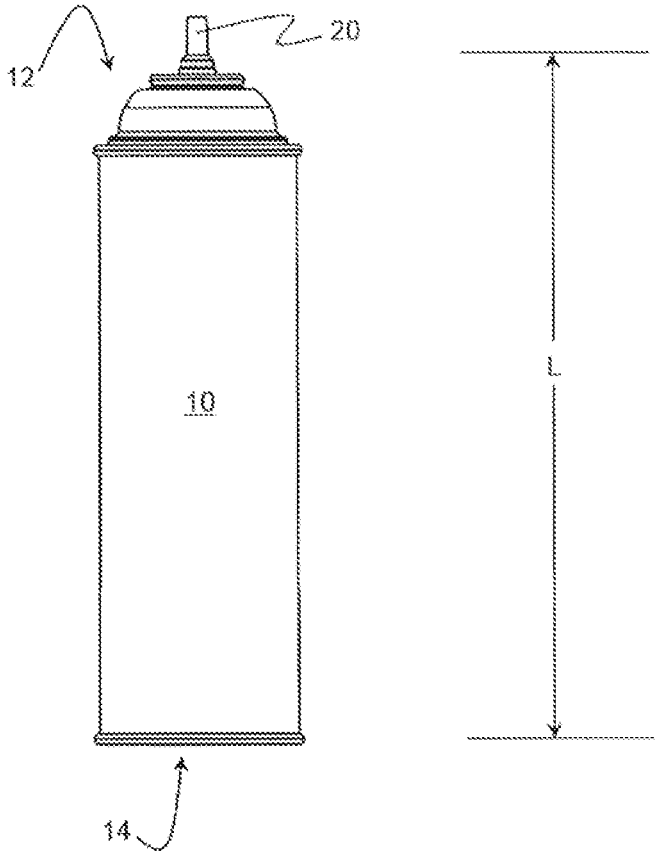
FIG. 1 provides a side view of a suitable can for use in the present invention.
Figure 4A:
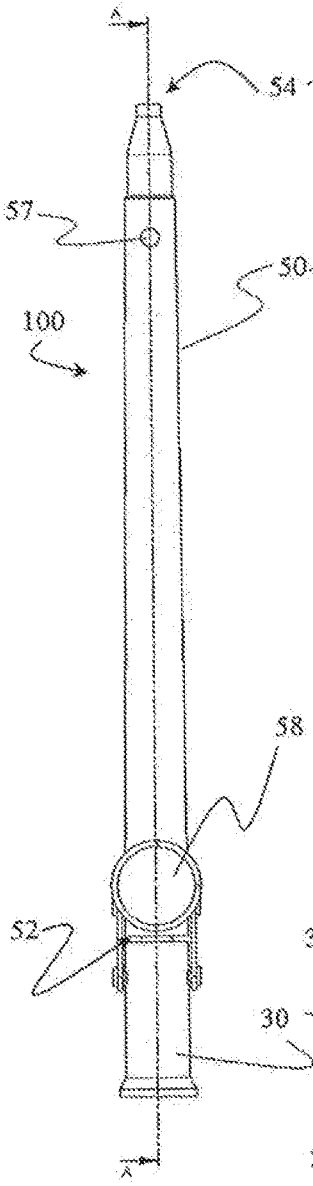
FIG. 4 provides an illustration of a dispensing device with (a) side view, (b) side view turned 90 degrees from (a), (c) cut-away side view along viewing line A shown in (a), and (d) a blow up view of dispensing end from (c). The dispensing device of FIG. 4 comprises a pair of elastic bands that serve as the elastic connector. The hollow tube has a closed exit end with multiple holes proximate to the exit end.
Figure 4B:
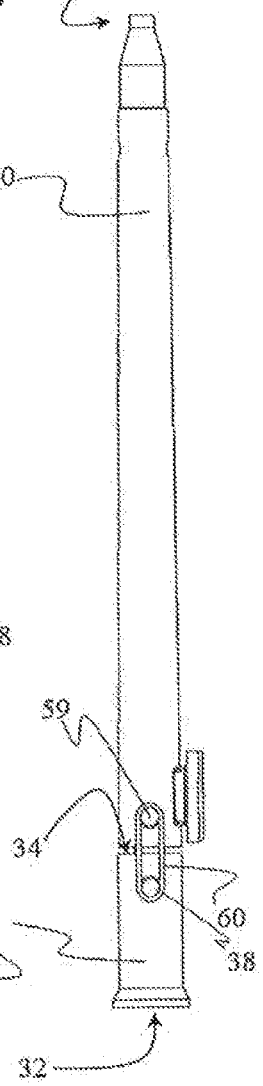
Figure 4C:
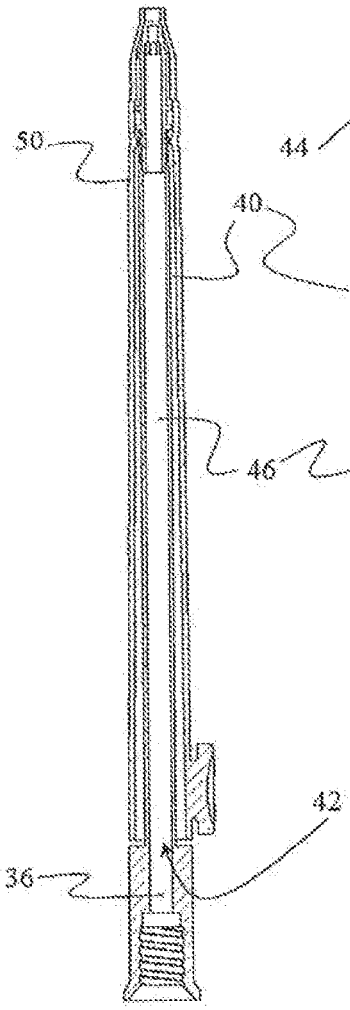
Figure 4D:
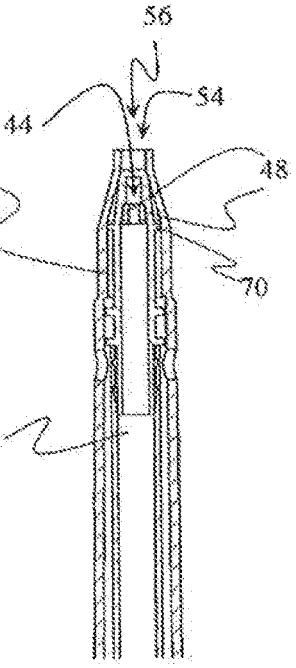

The article of the present invention comprises a can, such as can 10 illustrated in FIG. 1. The can has opposing top (12) and bottom (14) ends. Generally, the can is cylindrical in shape with the side of the cylinder corresponding to the length (L) of the can and the top and bottom ends separated by the length of the can. A valve stem (20) extends out from the top end of the can. The can may be filled with fluid material and pressurized at which time compressing the valve stem into the can, or tilting the valve stem relative to the can thereby compressing a portion of the valve stem into the can, opens the can and the pressurized contents may exit the can through the valve stem.

A dispensing device (100) is attached to the valve stem of the can. The dispensing device allows a user to hold the can with the length of the can extending in an axial direction with respect to the forearm of the user of the can while dispensing the contents of the can. Moreover, the dispensing device design allows a user to use a single hand, even a single finger, to simultaneously open the dispensing device and activate the valve stem to allow pressurized contents of the can to flow through the valve stem and the dispensing device for application onto a desired surface. Similarly, the dispensing device design allows a user to use a single hand, even a single finger, to simultaneously close and seal off the dispensing device and deactivate the valve stem to both stop flow of contents from the can and seal off the dispensing device so as to prevent drips.

Embodiments of dispensing devices suitable for use in the present invention are illustrated in FIGS. 2-5 and illustrate various exemplary embodiments of the different elements of the dispensing device. In the broadest scope of the present invention, it is anticipated that any embodiment of one element is combinable with any embodiment of any other element. The combinations in FIGS. 2-5 illustrate several different embodiments of each element and how they can combine to form embodiments of the present invention. Reference numbers below refer to FIGS. 2-5 for illustrations of embodiments of the specified elements. The elements in the Figures are not meant to define the broadest scope of the elements or invention.

The dispensing device comprises a hollow base (30) with opposing entrance end (32) and exit end (34). The hollow base has defined through it a hollow base flow channel (36) that extends all the way through the hollow base including through the entrance and exit ends. The hollow base is removably attached to the valve stem of a can so as to provide fluid communication from the valve stem into the hollow base flow channel of the hollow base. The valve stem fits into the entrance end of the hollow base so in that respect the entrance end of the hollow base is attached to the valve stem. The hollow base can have threading that extends within the hollow base flow channel proximate to its entrance end that mates with threading on the valve stem of a can thereby allowing the hollow base to screw onto the valve stem. Alternatively, the valve stem can fit into the hollow base flow channel through the entrance end and hold the hollow base in place by friction without threading.

The dispensing device further comprises a hollow tube (40) with opposing entrance end (42) and exit end (44). The hollow tube has a hollow tube flow channel (46) that extends all the way through the hollow tube including through the entrance end and through one or more than one hole proximate to the exit end. FIGS. 2 and 3 illustrate an embodiment of the present invention where there is a single hole (48) on the exit end of the hollow tube. FIGS. 4 and 5 illustrate an embodiment of the present invention where there are multiple holes (48) proximate to but not directly on the exit end of the hollow tube. The present invention also includes embodiments where there are multiple holes defined on the exit end of the hollow tube as well as embodiments with a single hole proximate to but not directly on the exit end of the hollow tube.

The hollow tube is affixed to the hollow base so that the exit end of the hollow base is proximate to the entrance end of the hollow tube and so that there is fluid communication between the hollow base flow channel and the hollow tube flow channel. The hollow base can be integral with a portion of or the entirety of the hollow tube, as is illustrated in FIGS. 2-5. That is, the hollow base and at least a portion of the hollow tube can be a single piece of material. Alternatively, the hollow base can be a separate piece of material from the hollow tube that attaches to the hollow tube. For example, the hollow tube can slide over a portion of the hollow base proximate to the exit end of the hollow base and either thread on, snap on with a ridge-groove mating system or merely fit snuggly enough to frictionally remain affixed to one another. When at least a portion of the hollow tube and hollow base are a single piece of material the base is distinguished from the hollow tube by being that portion that encompasses a portion of the valve stem of the can.

The dispensing device further comprises a sleeve (50) with lower end (52) and opposing dispensing end (54). The sleeve is positioned over at least a portion of the hollow tube and is able to reversibly slide over at least a portion of the hollow tube. The dispensing end of the sleeve is proximate to the exit end of the hollow tube. The sleeve defines a dispensing hole (56) through the sleeve proximate to, preferably on, the dispensing end.

The sleeve has a finger pad (58) proximate to the lower end 52. The finger pad is located on the side of the sleeve so that a user can apply pressure to the finger pad to: slide the sleeve over the hollow tube, tilt the dispensing device and valve stem with respect to the can, or both slide the sleeve over the hollow tube and tilt the dispensing device and valve stem with respect to the can. The finger pad is an object for a user to position a finger against when operating the dispensing device. The finger pad can be a protrusion (for example, a knob or button) extending off from the sleeve against which a finger can press to slide the sleeve up and/or down. Desirably, the finger pad is contoured so as to fit the general shape of a fingertip so that a user can comfortably press against the finger pad to actuate the dispenser. The finger pad can be a single piece of material that is integral with the sleeve. Alternatively, the finger pad can be a separate piece of material that is attached to the sleeve.

The dispensing device comprises an elastic connector (60) that attaches the sleeve proximate to the lower end of the sleeve to at least one of: (i) the hollow base; and (ii) the hollow tube. The elastic connector extends when the sleeve slides along the hollow tube away from the hollow base and provides a restoring force directed at sliding the sleeve along the hollow tube back towards the hollow base. The elastic connector can be any material that accomplishes the above stated performance. Examples of suitable elastic connectors include any one or more than one article selected from a group consisting of elastic bands, elastic strips and springs. The elastic connector can be made of an elastic polymer. Elastic connectors in the form of springs can comprise or consist of polymeric and/or metallic material. For avoidance of doubt, "band" includes articles of both strip and loop configurations.

FIGS. 2 and 3 illustrate an embodiment of an elastic connector (60) in the form of a spring attached to the sleeve proximate to the base end of the sleeve and attached to the hollow base below the hollow tube, the spring being coiled around the hollow base and/or hollow tube between the points of connection to the hollow base and sleeve. When the sleeve slides along the hollow tube away from the hollow base the elastic connector spring stretches thereby creating a restoring force to slide the sleeve back towards the hollow base.

FIGS. 4 and 5 illustrate an embodiment of an elastic connector (60) in the form of an elastic band attached to the sleeve near the finger pad and to the side of the hollow base. When the sleeve slides along the hollow tube away from the hollow base the elastic band stretches thereby creating a restoring force to slide the sleeve back toward the hollow base. The elastic band can be, for example, a rubber band or similar elastic band that loops over the finger pad or a protrusion (59) that extends out from the sleeve and over a protrusion (38) extending out from the side of the hollow base.

FIG. 5 illustrates a spring tether form of elastic connector (60) that uncoils as the sleeve is moved towards the exit end of the hollow tube thereby creating a restoring force to recoil.

The dispensing device can reversibly move between an open position and a closed position by sliding the sleeve along the hollow tube. When the dispensing device is in a closed position the sleeve (which can mean only a portion of the sleeve) seals all of the one or more than one hole proximate to the exit end of the hollow tube thereby preventing fluid communication from inside the hollow tube (that is, from the hollow tube flow channel) through any of the one or more than one holes to outside of the hollow tube. When the dispensing device is in an open position the sleeve does not seal one or more than one of the holes proximate to the exit end of the hollow tube thereby allowing fluid communication from inside the hollow tube to outside the hollow tube through one or more than one of the holes proximate to the exit end of the hollow tube. When the dispensing device is in a closed position, sliding the sleeve along the hollow tube towards the exit end of the hollow tube causes the sleeve to unseal the hole or holes proximate to the exit end of the hollow tube, and thereby corresponds to moving the dispensing device into an open position. When the dispensing device is in an open position, sliding the sleeve along the hollow tube towards the hollow base causes the sleeve to seal the hole or holes proximate to the exit end of the hollow tube thereby corresponding to positioning the dispensing device into a closed position.

With the finger pad proximate to the lower end of the sleeve, application of pressure by a finger on the pad conveniently slides the sleeve along the hollow tube so as to move the dispensing device into an open position. Release of the pressure on the finger pad allows the elastic connector to pull the sleeve back towards the hollow connector into a closed position. Moreover, when the dispensing device is attached to the valve stem of a can, applying pressure to the finger pad can simultaneously tilt the valve stem to open the can and slide the sleeve of the dispensing device into an open position with a single action by a single finger. Release of the pressure on the finger pad allows the valve stem to return to a closed position and the elastic connector to orient the sleeve so as to position the dispensing device into a closed position. Hence, operation of the dispensing device to dispose contents of a can to which the dispensing device is attached can be accomplished with a single finger to both open the can and the dispensing device by pressing a finger against the finger pad to slide the sleeve and tilt the valve stem, as well as subsequently close the can and seal the dispensing device in a closed position by releasing pressure on the finger pad.

The hollow tube can be of uniform outside diameter or, preferably, tapers to a smaller diameter proximate to the exit end of the hollow tube as shown in FIGS. 4 and 5. Similarly, the portion of the sleeve that extends over the hollow tube proximate to the exit end of the hollow tube can be uniform in inside diameter. Alternatively, if the hollow tube tapers to a smaller outside diameter proximate to the exit end of the hollow tube the portion of the sleeve that extends over the hollow tube proximate to the exit end of the hollow tube also can taper to a smaller inside diameter proximate to the exit end of the hollow tube—preferably so that the outside of the tapered end of the hollow tube fits against the inside of the sleeve when the dispensing device is in a closed position.

The hollow tube and/or sleeve can be a single piece or comprise multiple pieces attached together. For example, when the hollow tube has a tapered end it can be advantageous to prepare a tapered tip section separate from a first section that comprises the rest of the hollow tube where the first section includes the entrance end of the hollow tube and the tip section includes the exit end of the hollow tube as well as the one or more hole proximate to the exit end of the hollow tube. The tip section attaches to the first section of the hollow tube so that the tapered tip comprises the tapered end of the hollow tube. Separate pieces can attach to one another by any means. For example, the pieces can comprise mating ring and grooves where a ring (or other protrusion) of one piece snaps into mating configuration with a groove (or other depression or hole) in another piece.

In the broadest scope of the invention, the sleeve can seal the hole or holes proximate to the end of the hollow tube when the dispensing device is closed by any conceivable means. For example, the sleeve can define protrusions that slide into or against the hole or holes of the hollow tube when the dispensing device is placed into a closed position but slide out or away from the hole or holes when the dispensing device is moved into an open position. FIGS. 2 and 3 illustrate a version of this embodiment where sleeve 50 comprises protrusion 500 extending inwards towards hollow tube 40, which defines opening 48 on the exit end. When the dispensing device is closed, protrusion 500 presses against or into opening 48 so as to seal opening 48 to preclude fluid communication from the flow channel of the hollow tube through opening 48. When the dispensing device is in an open position, protrusion 500 is apart from opening 48 so as to allow fluid flow from the flow channel of the hollow tube through opening 48 and through one or more than one dispensing hole 56 around protrusion 500.

When the one or more than one hole 48 is proximate to, but not on the exit end of the hollow tube then there are additional configurations possible for precluding fluid flow when the dispensing device is in the closed position. For instance, the closed exit end of the hollow tube can press against the sleeve so as to form a seal around the hollow tube that precludes fluid flow between the hollow tube and sleeve from the one or multiple holes out from the dispensing end of the sleeve. At the same time, a gasket may preclude fluid flow between the hollow tube and sleeve towards the entrance end of the hollow tube. This is the situation in the configuration of FIGS. 4 and 5, which illustrate a dispensing device in the closed position with exit end 44 of hollow tube 40 sealing against sleeve 50 and holes 48 residing between where the exit end 44 seals against sleeve 50 and sealing gasket 70. In FIGS. 4 and 5, both the inside diameter of the sleeve and the outside diameter of the hollow tube taper to smaller diameters proximate to the dispensing and exit ends respectively. When in the open position the sleeve is displaced from the close end of the hollow tube thereby allowing fluid flow from the one or multiple holes in the hollow tube proximate to the exit end and out from the dispensing end of the sleeve. Additionally, or alternatively, the sleeve can press against the hollow tube around hole or holes 48, and/or extend protrusion into holes 48, so as to directly seal the one or more than one hole proximate to the entrance end of the hollow tube when closed. The sleeve can then offset from the one or multiple holes when in an open position. In either of these configurations, it is desirable for the hollow tube to taper to a narrower outer diameter proximate to the exit end of the hollow tube and for the sleeve to taper to a narrower inner diameter proximate to the dispensing end of the sleeve. The tapered shape facilitates sealing of the dispensing device in the closed position as the hollow tube resides in a narrowed inner diameter of the sleeve, but in the open position the exit end of the hollow tube resides in a larger inner diameter of the sleeve thereby facilitating flow from the one or more than one hole in the hollow tube, around the exit end of the hollow tube and out through the dispensing end of the sleeve.

Sealing gasket 70 resides around the outside of the hollow tube between the hollow tube and sleeve so that the gasket prevents fluid flow between the hollow tube and sleeve past the gasket. Desirably, the sealing gasket contacts both the hollow tube and sleeve all the way around the hollow tube (that is, around the circumference of a cross section of the hollow tube). Sealing gasket 70, when present, is located between the hole or holes 48 and the entrance end 42 of hollow tube 40, preferably proximate to the hole or holes 48. The sealing gasket contacts both the wall of the hollow tube and the sleeve in a manner that prevents fluid flow past the sealing gasket along the outside of the hollow tube between the hollow tube and the sleeve. The sealing gasket acts as a barrier preventing fluid exiting the exit end of the hollow tube to travel along between the hollow tube and sleeve past the sealing gasket and instead forces the fluid to exit the dispensing end of the sleeve. The sealing gasket desirably wraps all the way around the outside of the hollow tube (for example, a ring of material around the hollow tube). The sealing gasket can be attached to or part of (that is, integral with such as molded into) either the outside of the wall of the hollow tube or the inside of the sleeve. Conceivably, the sealing gasket can be attached to neither the hollow tube nor sleeve but rather frictionally held between the hollow tube and sleeve. The sealing gasket can be a rigid material such as a rigid plastic, but is preferably an elastic material that contacts one or both of the hollow tube and sleeve so that the sealing gasket can conform to both the hollow tube and sleeve to form a fluid impervious seal even as the sleeve slides along the hollow tube between open and closed positions. Examples of suitable elastic sealing gasket materials include rubber materials such as nitriles and ethylene propylene diene monomer rubber (EPDM).

It is desirable for the article of the present invention to have the hollow tube extending co-linearly with respect to the valve stem and length of the can when attached to the valve stem and when in a closed position. In such a configuration, the article of the present invention is readily operable in one hand in an axial direction with respect to the forearm of the hand. That allows access to difficult to reach locations, those locations that require a long reach to access and to make dispensing more comfortable and less fatiguing to a user.

Figure 6:
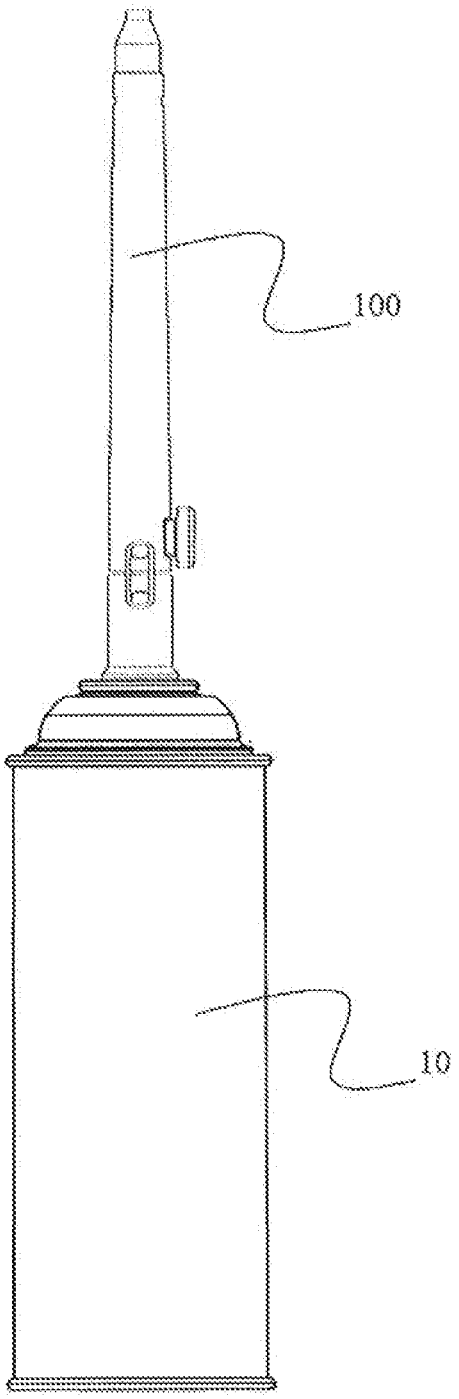
FIG. 6 illustrates can of FIG. 1 with dispensing device of FIG. 4 attached thereto as an illustration of an article of the present invention.

FIG. 6 illustrates an article of the present invention comprising the dispensing device of FIG. 4 attached to the can of FIG. 1. The dispensing device is attached to the valve stem of the can so that the valve stem extends into the hollow base flow channel. The hollow tube extends co-linearly with respect to the vale stem and length of the can. Similarly, the dispensing device of any of FIGS. 2-5 can attach to the valve stem of the can of FIG. 1 in like manner.

The dispensing device can comprise or be free of a position indicator that provides a visual indication of whether the dispensing device is in an open position or a closed position. One example of a position indicator is a hole (57, shown in FIGS. 4 and 5) in the side of the sleeve proximate to the dispensing end that reveals a portion of the hollow tube and wherein the portion of hollow tube evident through the hole when the dispensing device is closed is one color, and when open is another color.

The invention claimed is:

1. An article comprising a can (10) having opposing top (12) and bottom (14) ends with a valve stem (20) extending out from the top end and a dispensing device (100) attached to the valve stem, wherein the dispensing device comprises:

a. a hollow base (30) with opposing entrance (32) and exit (34) ends and defining a hollow base flow channel (36) extending all the way through the hollow base including through the entrance and exit ends with the entrance end removably attached to the valve stem of the can so as to provide fluid communication from the valve stem into the hollow base flow channel of the hollow base;

b. a hollow tube (40) with opposing entrance (42) and exit (44) ends and defining a hollow tube flow channel (46) extending all the way through the hollow tube including through the entrance end and through one or more than one hole (48) proximate to the exit end, wherein the hollow tube is affixed to the hollow base so that the entrance end of the hollow tube is proximate to the exit end of the hollow base so as to establish fluid communication between the hollow base flow channel and hollow tube flow channel and so the two flow channels become continuous;

c. a sleeve (50) with opposing lower (52) and dispensing (54) ends and a finger pad (58) proximate to the lower end, wherein the sleeve extends over and is able to slide over at least a portion of the hollow tube such that the dispensing end of the sleeve is proximate to the exit end of the hollow tube and wherein the sleeve defines a dispensing hole (56) proximate to the dispensing end;

d. an elastic connector (60) that attaches the sleeve to at least one of the hollow base and hollow tube proximate to the lower end of the sleeve such that when the sleeve slides along the hollow tube away from the hollow base the elastic connector provides a restoring force to slide the sleeve along the hollow tube back towards the hollow base; and e. a sealing gasket (70) around the outside of the hollow tube between the hollow tube and sleeve and located between hole or holes (48), which are proximate to the exit end of the hollow tube, and the entrance end of the hollow tube;

wherein the dispensing device can reversibly move between an open position and a closed position by sliding the sleeve along the hollow tube, the closed position being characterized by the sleeve sealing the one or more than one hole in the hollow tube proximate to the exit end of the hollow tube and the open position being achieved by sliding the sleeve from the closed position along the hollow tube away from the hollow base so as to unseal the one or more than one hole through the hollow tube allowing fluid flow from the hollow tube flow channel out from the sleeve proximate to the dispensing end; and wherein a single action of pressing a finger against the finger pad is able to slide the sleeve to an open position and to tilt the valve stem to dispense pressurized contents of the can through the hollow tube and wherein subsequent single finger action of releasing pressure on the finger pad results in both return of the valve stem to a closed position for the can and return of the sleeve to a closed position;

wherein the hollow tube has a tapered hollow tube section that narrows in outside diameter proximate to the exit end and has defined through the tapered hollow tube section a hole and wherein the sleeve has a tapered sleeve section that narrows in inside diameter proximate to the dispensing end and wherein the hollow tube tapered section and tapered sleeve section fit together when the dispensing device is in a closed position such that the sleeve seals the hole in the tapered hollow tube section thereby preventing fluid flow through the hole, and when the dispensing device is in an open position the sleeve is displaced from the hole in the tapered hollow tube section thereby allowing fluid flow through the hole.

2. The article of claim 1, wherein the hollow tube comprises multiple pieces attached together.

3. The article of claim 2, wherein the hollow tube comprises a first section that is attached to a tip section wherein the first section includes the entrance end of the hollow tube and the tip section includes the exit end of the hollow tube and the one or more than one hole proximate to the exit end of the hollow tube.

4. The article of claim 1, wherein the hollow base and at least a portion of the hollow tube are a single piece.

5. The article of claim 1, wherein the elastic connector is selected from one or more than one element selected from a group consisting of one or more than one elastomeric polymer band, a coiled band, and a spring.

6. The article of claim 1, wherein the hollow tube extends co-linearly with respect to a valve stem of a can when attached to the valve stem and when in a closed position.

* * * * *